United States Patent [19]

Palandri

[11] 4,420,733

[45] Dec. 13, 1983

[54] MINIATURIZED ELECTROMAGNETIC RELAY

[75] Inventor: Fabio V. Palandri, Milan, Italy

[73] Assignee: AMF Incorporated, White Plains, N.Y.

[21] Appl. No.: 361,716

[22] Filed: Mar. 25, 1982

[51] Int. Cl.[3] ..... H01H 45/02; H01H 50/04

[52] U.S. Cl. ..... 335/202; 335/135

[58] Field of Search ..... 335/202, 135, 128, 133

[56] References Cited

U.S. PATENT DOCUMENTS 4,101,856 7/1978 Durr ..... 335/202

4,346,359 8/1982 Pirner et al. ..... 335/202

*Primary Examiner*—Harold Broome

*Attorney, Agent, or Firm*—David E. Dougherty

[57] ABSTRACT

A miniaturized electromagnetic relay having a yoke-coil-armature-return spring assembly and contact bearing blades arranged to be inserted into an insulating monolithic supporting structure. The support structure is formed by a front wall and a partition wall perpendicularly projecting therefrom for separating the front wall into two portions, with one of said portions being effective to receive the yoke-coil-armature assembly and the related return spring, and the other portion being effective to receive the contact bearing blades.

The partition wall is provided with a C-shaped cross-section having guiding and supporting means for said yoke-coil-armature assembly and related return spring. The upper portion of the front wall is provided with two sets of slots separated from one another by a partition member for receiving the contact bearing blades therein. The slots include plug-in or socket means effective to receive plug mating or coupling means formed on the contact bearing blades in order to support the blades at the proper predetermined positions defined by the slots. A case is provided with snap locking means effective to cooperate with complementary means provided on the insulating support structure.

9 Claims, 8 Drawing Figures

MINIATURIZED ELECTROMAGNETIC RELAY

BACKGROUND OF THE INVENTION

The present invention generally relates to electromagnetic relays and, more specifically, to a power miniaturized electromagnetic relay for printed circuit boards.

These relays generally comprise an energizing coil, a yoke encompassing the energizing coil, a swinging armature with return spring and a contact bearing block effective to house a plurality of contact tabs. The contact bearing block is generally made in a single piece and is provided with slots for the insertion of the contact blades which, after being inserted thereinto, are affixed by means of an adhesive material.

After having affixed the contact tabs it is necessary to control the precise mutual position of the contacts in said contact block, which operation may required a further manual adjusting or calibrating step.

In printed circuit board there is frequently a need to utilize the so-called miniaturized electromagnetic relays which, owing to their small (component) size, require expensive manual assembly. This fact is also true for the so-called power miniaturized relays wherein the energizing coil receives a low voltage/current, whereas its contact blades have applied thereto a higher voltage/-current. In this case, due to safety reasons, it is necessary that between the magnetic circuit and the plurality of contact blades an insulating distance, for example, of at least 8 mm for a voltage in the range of 4 KV is maintained.

SUMMARY OF THE INVENTION

A miniaturized electromagnetic relay generally of the type having a yoke-coil-armature assembly, a return spring and contact bearing blades. A monolithic supporting structure of insulating material is provided having a front wall with a partition wall projecting perpendicularly from the front wall and separating said structure into two portions, one thereof being provided for receiving the yoke-coil-armature assembly and the return spring, while the other is provided for receiving said contact bearing blades. The perpendicularly extending partition wall has a generally inverted square U-shaped or C-shaped cross-section with guiding and supporting means on the inside thereof for mounting the yoke-coil-armature assembly and the return spring thereon. (The term C-shaped or U-shaped cross-section is used throughout to generally mean a structure having a first wall 3 with two generally downwardly directed walls 3*a* and 3*b* extending therefrom). The front wall portion contains two sets of slots each having a plurality of slots each receiving one end of a respective contact bearing blade. The slots are separated from one another by a partition member provided with (plug-in) means effective to receive mating means provided on said contact bearing blades to support said blades at predetermined positions corresponding with said slots. A case is provided having snap locking means effective to cooperate with complementary means provided on the insulating support structure.

In this manner, a two-point supporting alignment structure/assembly is obtained for mounting the contact bearing blades in a stabilized manner at the desired positions, as well as providing an improved mounting means for the movable contact bearing blades to enable a simple replacing of a damaged blade, for example, during the relay assemble stage.

Accordingly, an object of the present invention is to provide a miniaturized electromagnetic relay which is rather improved, particularly with respect to the shape and arrangement of the contact bearing blades, as well the shape of the coil-yoke and return spring assembly.

Another object of the present invention is to provide a miniaturized electromagnetic relay effective to afford the advantageous possibility of locating the terminals or pins to be coupled to the printed circuit board according to a variable pitch or slope.

Yet another object of the present invention is to provide a miniaturized electromagnetic relay effective to allow for one or two switching contacts, substantially insulated from one another, to be used at will, without the necessity of varying or changing the basic structure.

Yet another object of the present invention is to provide a miniaturized relay of the type therein above mentioned, effective to offer the advantage of a quick assemblying of its component parts without requiring further end calibrating or adjusting operations on the contacts.

Yet another object of the present invention is to provide a miniaturized electromagnetic relay effective to insulate the magnetic circuit from the electric circuit, and, in particular to meet the air gap requirement of 8 mm therebetween.

BRIEF DESCRIPTION OF THE DRAWINGS

The invention will now be described in detail with reference to a preferred embodiment thereof, given only by way of a nonlimitative and indicative example, being illustrated in the accompanying drawings, wherein.

DESCRIPTION OF THE PREFERRED EMBODIMENTS

Figure 1:
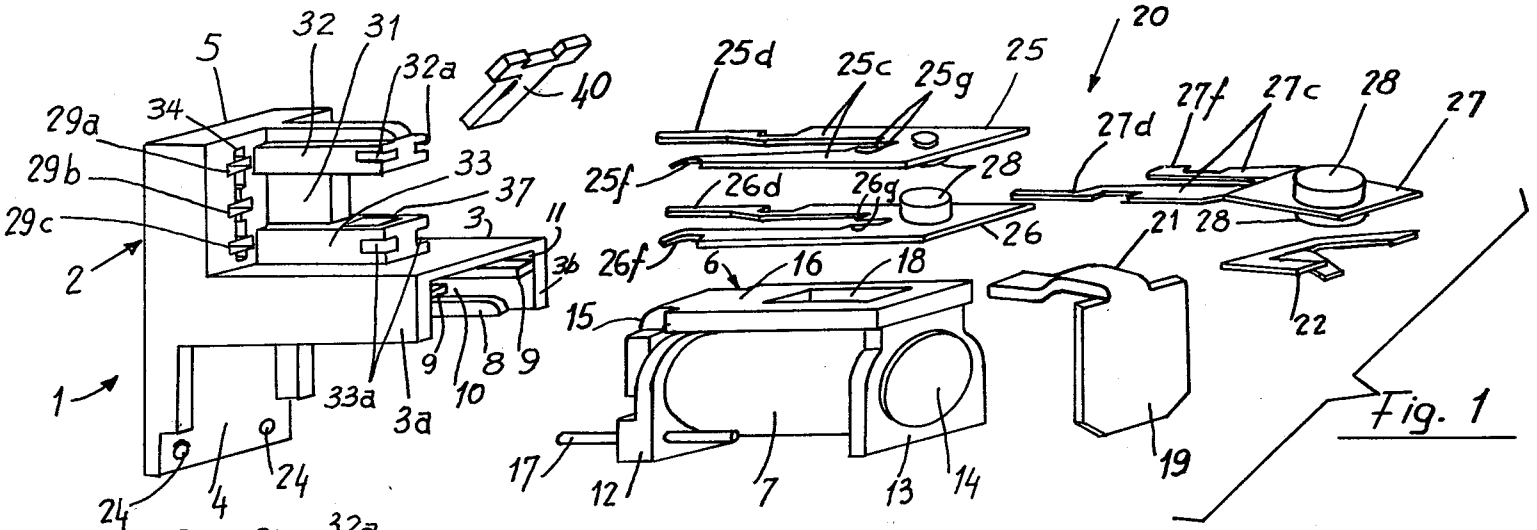
FIG. 1 is an exploded view of the minaturized electromagnetic relay according to the present invention, designed as a single switching contact relay.
Figure 2:
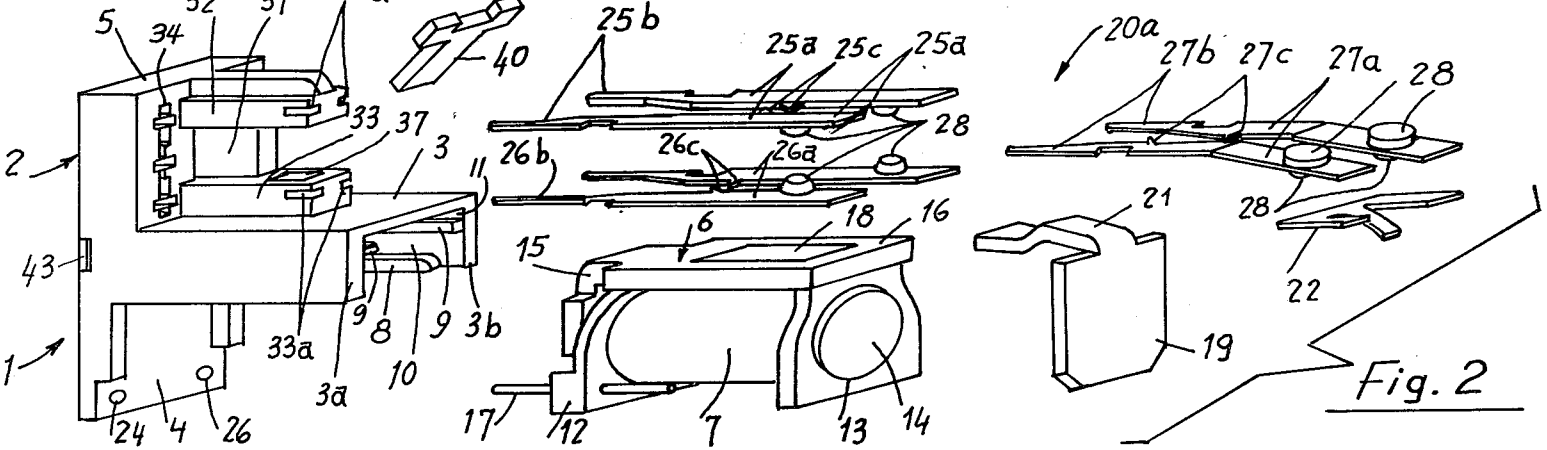
FIG. 2 is a view analogous to FIG. 1, but illustrating a relay designed as a two-switching contact relay.

As shown in the figures, the relay comprises a monolithic supporting structure 1, consisting of a front wall 2 having a wall 3 projecting perpendicularly generally from the central portion thereof. The partition wall 3 is of C-shaped cross-section and divides the front wall into two portions 4 and 5. The central portion 4 is provided for containing the assembly of the components of the magnetic circuit, while portion 5 generally defines a region provided for housing the contact bearing blades 20. The partition wall 3 contains a pair of longitudinally extending strips or support rails 8 and 9 on each inside wall 3*a* and 3*b*, forming a pair of guide slots 10 and 11 open at the end of the partition wall spaced or opposite from the front wall 2.

The energizing coil 7 of the relay is supported by conventional means on a core 14 located between two flanges 12 and 13. A yoke 6 is provided with a side 15 having a right angle bent portion and fixed to the core 14, with the free side thereof, indicated at 16, extending parallel to the core 14 as far as the flange 13. The flange 12 carries the terminals 17 (only one shown) for the coil 7. The free side 16 of the yoke is provided with a rectangular louver or slot 18. The magnetic circuit of the relay is further completed by the conventional armature 19 to be located in front of the core 14 and provided with an arm 21 bent at about 90°, the end thereof is provided for being introduced into said rectangular louver or slot 18 of the yoke 6.

During the assemblying of the relay, the armature 19 is inserted with its arm 21 into the rectangular louver or slot 18 of the yoke 6 and then the slide 16 of the yoke, with the coil 7, is inserted into the pair of opposed slots 10 formed in the sides of the box-shaped walls 3*a* and 3*b*, until the terminals 17 of the coil penetrate suitable holes 24 provided through the portion 4 with flange 12 abutting portion 4. Then the return spring 22 is inserted into the opposed slots 11 of the sides of the transversal walls 3*a* and 3*b*, in such a way as to rest against the armature 19 to cause said armature to return to the not attracted position when the coil is deenergized.

Figure 3:
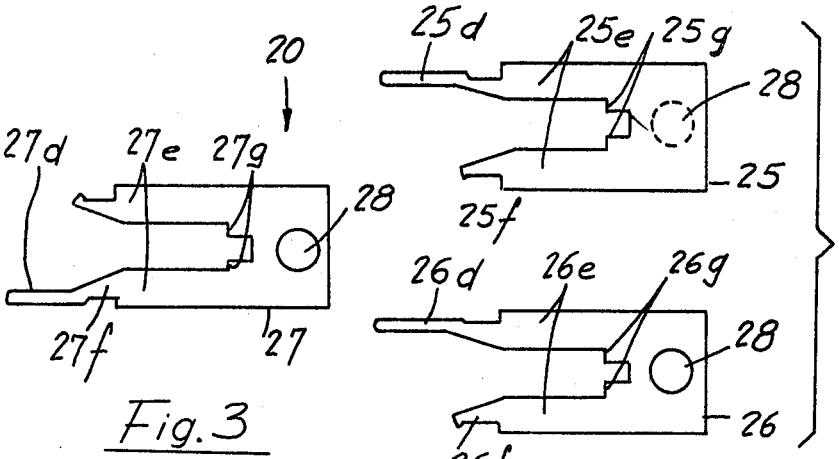
FIG. 3 is a plan view illustrating the shape of the contact bearing blades for the relay provided with a single switching contact.
Figure 5:
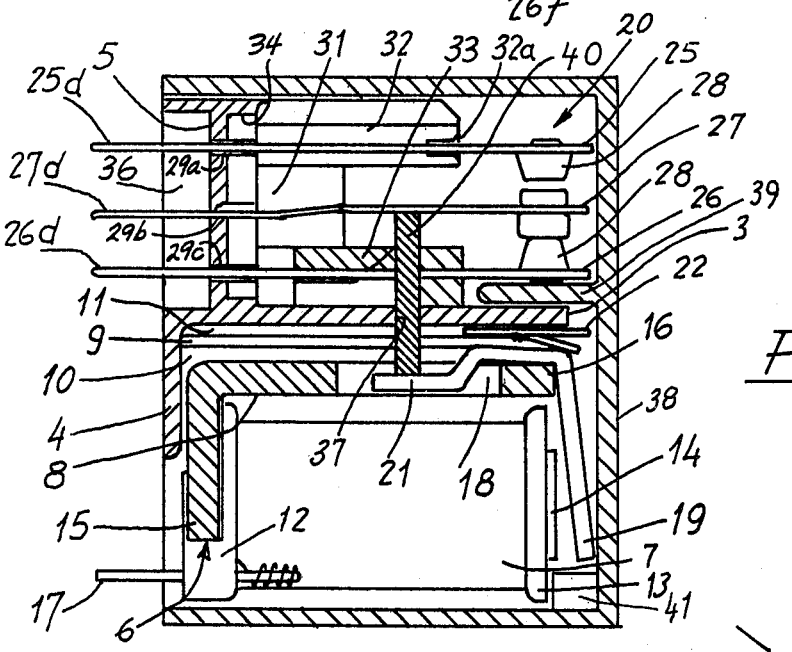
FIG. 5 is a partially sectioned view of the relay in an assembled condition.
Figure 4:
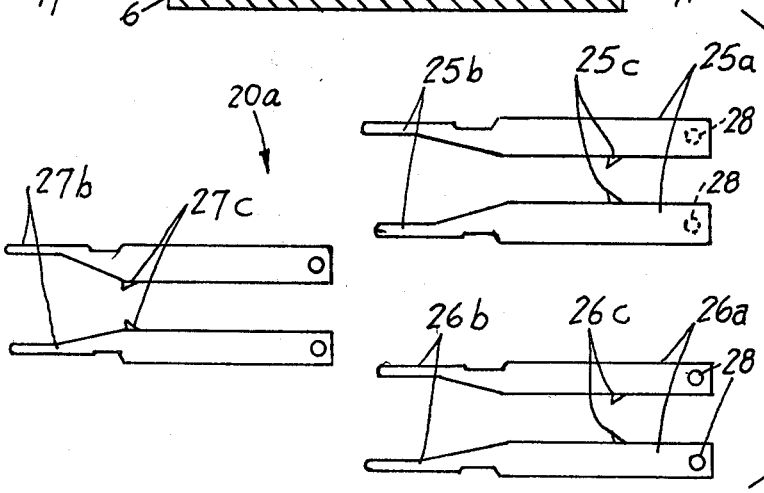
FIG. 4 is a top plan view illustrating the shape of the contact bearing blades for the relay provided with two switching contacts.
Figure 6:
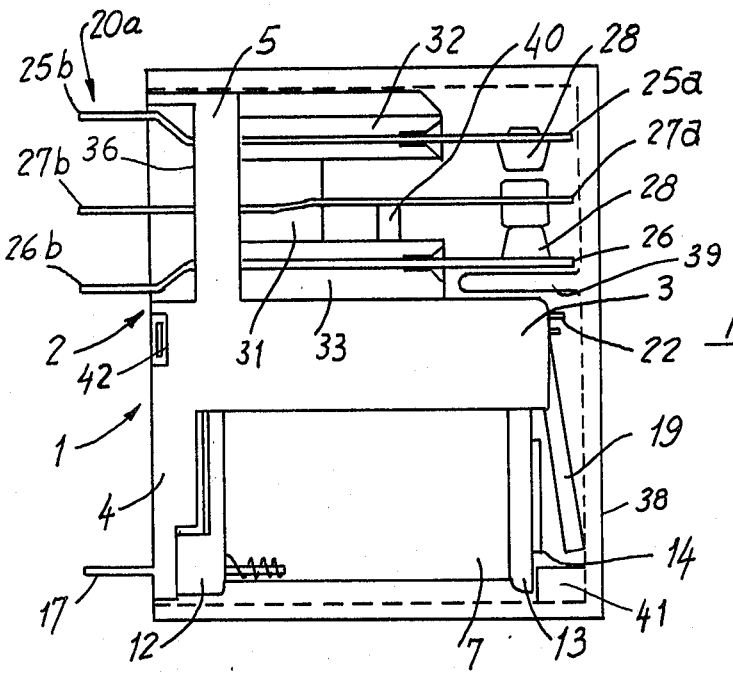
FIG. 6 is a side elevation view of the assembled relay, having the terminals or pins of its electric circuit located according to a greater pitch.
Figure 7:
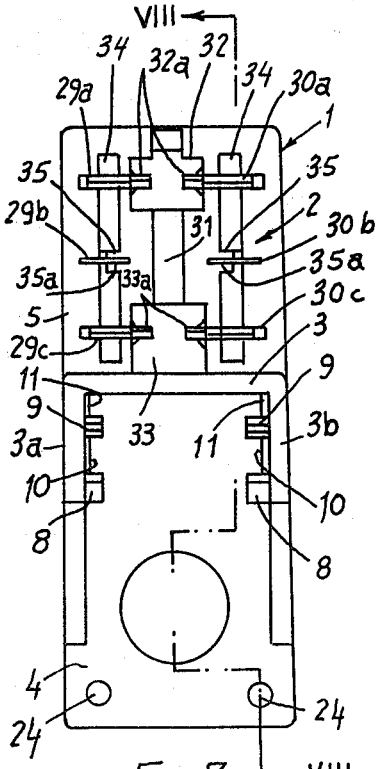
FIG. 7 is a front elevation view of the insulating supporting structure.
Figure 8:
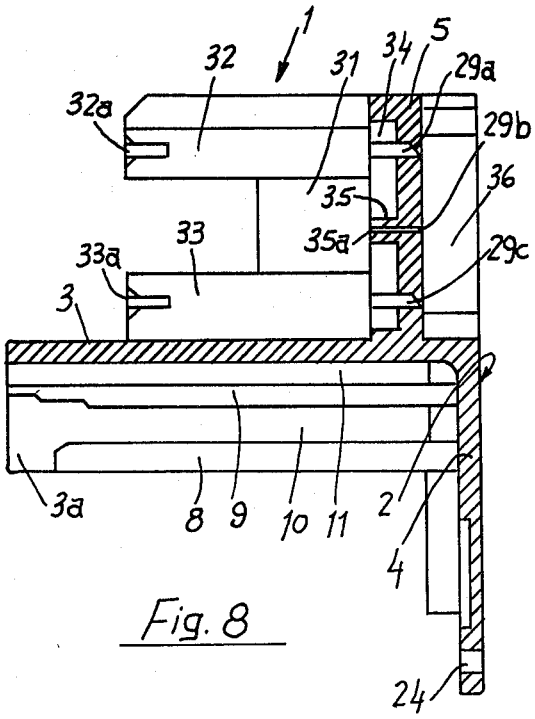
FIG. 8 is a cross-sectional view taken along the line VIII—VIII of FIG. 7.

The plurality of contact bearing blades 20 shown in FIGS. 3 and 5 are designed for relays having a single switching contact and consist of a fixed upper and lower blade 25 and 26, respectively, and an intermediate movable blade 27. The blades 20*a* shown in FIGS. 4 and 6 are designed for relays provided with two switching contacts and consist of a fixed upper and lower blade pair 25*a* and 26*a*, respectively, and a movable blade pair 27*a*. The blades 25, 25*a* and 26, 26*a* and 27, 27*a* support the contacts 28.

Portion 5 of the front wall 2 is provided with two groups or sets of three slots 29*a, b, c,* and 30*a, b, c* which are separated from one another by means of a partition member 31 provided at the top and bottom thereof, with a projection 32 and 33 having a substantially parallelepipedal or rectangular shape with notches 32*a*, 32*b* and 33*a*, 33*b* respectively, along their front corners and located at the same level as the slots 29 and 29*c*, respectively. The parallelepipedic projections extend for over one half of the length of the box-shaped wall 3.

On the front surface of wall portion 5 there are formed slots 34 corresponding to each slot 29*a*-30*a*-29*b*, 30*b*-29*c*-30*c* which, at the central slots 29*b*, 30*b*, are provided with inwardly directed ridges or projections 35 having notches 35*a*.

The contact bearing blades 25, 26, 27 of the single switching contact relay are formed by a rectangular body bearing the contact 28 which latter is cut in such a way as to present two legs 25*e*, 26*e*, 27*e* merging with the body by means of two opposite steps 25*g*, 26*g*, 27*g*, and elongated tab 25*d*, 26*d*, 27*d* and a short tab 25*f*, 26*f*, 26*f*. The steps 25*g* and 26*g* of the fixed blades are effective to be inserted into the notches 32*a* and 33*a*, while the elongated tabs 25*d*, 26*d*, 27*d* are effective to be inserted into the slots 30*a*, 30*c* and 29*b* in such a way as to project therefrom for forming the coupling terminals or pins to the printed circuit board. The short tabs 25*f*, 26*f* and 27*f* are provided for being simply inserted into the slots 29*a*, 29*c* and 30*b* respectively. In this manner the fixed blades are guided and supported by the projections 32 and 33 for a substantial portion of the length thereof, which contributes to the stiffening and precise locating thereof, since they are supported at two points, while the movable blade is supported only at the related slots and is guided by the partition member 3.

The contact bearing blades 25*a*, 26*a*, 27*a* for a two switching contact relay are formed by a strip ending with a thin tab 25*b*, 26*b*, 27*b* with tooth members 25*c*, 26*c* and 27*c* provided on the inside thereof. The teeth 25*c* and 26*c* of the fixed blades 25*a* and 26*a* are located in such a position as to engage with the notches 32*a* and 33*a*, respectively, while the tabs 25*b*, 26*b* penetrate the related slots 29*a*, 30*a* and 29*c*, 30*c* in such a way as to project at the rear for forming the coupling terminals to the printed circuit board.

The teeth 27*c* of the movable blades 27*a* are located in such a position as to engage into the notches 35*a* of the ridges 35 formed at the slots 29*b*, 30*b* thereinto the tabs 27*b* are inserted, these latter projecting at the rear for forming the terminals for carrying out the coupling to the printed circuit board. This is effective to improve the precise locating of the movable contact blades.

At the rear, the wall portion 5 is provided with a rectangular recess 36 so sized as to permit the terminals of the projecting movable tabs to be bent according to an increased pitch. In fact the slots 29*a*, 30*a*, 29*b*, 30*b*, 29*c*, 30*c* are arranged according to a pitch of 3.5 mm, and, when the tabs rectilinearly project (FIG. 5) form coupling terminals having a pitch of 3.5 mm, whereas with the terminals of the movable blades being bent as shown in FIG. 6, they have a pitch of 5 mm. This characteristic is one of the advantages of the relay according to the invention.

The box-shaped wall 3 and the lower projection 33 of the partition member 31 contain an opening 37 effective to receive the driving or operating member 40 for the movable contact. Operating member 40 is T-shaped in such a way as to be suitable as a driving pusher arm in either the single switching blade and the two switching blade relay embodiment. Said driving member 40 has a length of approximately 8 mm and rests from one side against the arm 21 of the armature 19 located in the louver or slot 18 of the yoke 7 and, from the other side, against the movable blade or blades 27, 27*a*.

In accordance with the above described relay arrangement, it is possible to obtain an insulating gap of 8 mm between the magnetic circuit and the contact bearing blades or electric circuit, as may be required by safety rules or standards, in order to obtain a voltage rating of 4 KV.

Finally, the relay is complete by a housing or casing, of box or parallepipedal shape, 38 opened at one side thereof and effective to be plug-in inserted on the assembled relay structure, and provided, on the two open sides thereof, with tooth members 42 effective to snap engage with recesses 43 as formed on the sides of the insulating supporting structure. Said casing 38 is provided, on the front wall thereof, with a perpendicularly extending projection 39 effective to be located between the contact blades and the box-shaped wall 3 in order to provide a minimum air gap of 8 mm at the open end of the relay, between the magnetic circuit and the electric circuit and moreover with a small central ridge 41 located at one inner corner thereof, provided for pushing the coil-yoke assembly against the wall portion 4 in such a way as to hold said assembly in its position, in the assembled relay condition.

Thus it should be noted that, by inserting the fixed contact bearing blades 25, 26 and 25*a*, 26*a* into the related slots as far as the steps 25*g*, 26*g*, respectively, teeth 25*c*, 26*c* are insertable into the respective notches 32*a*, 33*a*. And by inserting the movable contact bearing blades 27, 27*a* to abut against the front wall of the partition member 31, or the teeth 27*c* fixedly insert into their respective notches 35*a*, to enable a precise locating of the blades with respect to one another, without the need of carrying out further calibrating or adjusting operations.

The relay according to the present invention substantially affords one or more of the following advantages:

(1) the coil-yoke-return spring is made as a completely independent component;

(2) the yoke is provided with a louver or slot in which the armature is received or partially housed which latter is flush with respect to the yoke, thereby it does not alter the magnetic field and it is possible to obtain the insulating gap of 8 mm from the contact bearing blades.

(3) The coil-yoke-armature assembly and the related return spring is effective to be plugged into the supporting structure, which is monolithic, insulating and bears the contacts, by means of a sliding guide, the final locating and sealing being obtained by means of said closure protecting casing or housing.

(4) the protecting casing is provided with insulating projections which are effective to be plugged in the insulating supporting structure in such a way as to provide a minimum air gap of 8 mm, even at the end portion, between the magnetic circuit and the electric circuit of the relay.

(5) the driving member is of T-shape and effective to be plugged in an opening formed in the transversal or cross wall of the insulating supporting structure and has a height less than 8 mm, to assure said insulating gap.

(6) the insulating supporting structure is so designed as to be able of carrying either one or two switching contacts.

(7) The inserting and locating of the contact bearing blades are carried out by means of locating tooth members which engage with the supporting structure contemporaneously, thereby also obtaining a predetermined vertical locating, which eliminates the need of carrying out subsequent calibrating or adjusting steps and allows for a damaged blade to be easily replaced.

(8) at the output toward the printed ciruit board the insulating supporting structure is so shaped as to be enable use of housing terminals or points having a variable pitch from 3.5 to 5 mm.

While the invention has been illustrated and described with respect to the preferred embodiment(s) thereof, it should be pointed out that it is susceptible to any variations and modifications falling within the scope of the invention idea and within the experience of those skilled in the art.

I claim:

1. A miniaturized electromagnetic relay of the type having a yoke-coil-armature assembly and related return spring and contact bearing blades effective to be inserted into an insulating support structure formed by a front wall with a wall extending perpendicularly therefrom for separating said structure generally into two portions, with one portion being provided for receiving the yoke-coil-armature assembly and the return spring, while the other portion is provided for receiving said contact bearing blades, characterized in that:

the perpendicularly extending wall is generally of C-shaped cross-section having guiding and supporting means for receiving said yoke-coil-armature assembly and the return spring; the front wall contains a first and a second group of slots provided therein for receiving a portion of said contact bearing blades and a partition member disposed between said first and second group of slots having means effective to receive mating coupling means provided on said contact bearing blades to support said blades at a predetermined position with respect to said slots; and a parallel piped housing open only on one side and including locking means effective to cooperate with complementary means provided on said insulating supporting structure, thereby cooperating with said front wall to receive and enclose said supporting structure yoke-coil-armature assembly, spring and contact bearing blade.

2. A miniaturized electromagnetic relay according to claim 1, characterized in that said partition member includes a top and a bottom projection member each having front corner portion means effective to supportively receive said mating coupling means provided on the fixed contact bearing blades at two points thereof in order to stiffen said blades and hold said blades at predetermined positions.

3. A miniaturized electromagnetic relay according to claim 1, characterized in that said front wall portion provided for receiving said contact bearing blades is provided, on the coupling side thereof to a printed circuit board, with such a shape effective to allow for the terminal tabs or pins to be located according to different pitches.

4. A miniaturized electromagnetic relay, according to claims 1 or 2 or 3, characterized in that the blade support means of said partition member consist of notches and in that the mating coupling means formed on said contact bearing blades consist of projecting tooth members.

5. A miniaturized electromagnetic relay according to claim 1, characterized in that the yoke of said yoke-coil-armature assembly is provided with a slot effective to receive an operating arm of said armature said arm being located in front of a core of said coil opposite from said front wall.

6. A miniaturized electromagnetic relay according to claim 1, characterized in that said yoke-coil-assembly and return spring supporting and guiding means consist of two pairs of rails provided on the sides of said C-shaped wall to form two pairs of opposite guide slots, one said slot pair being provided for receiving a portion of the yoke-coil-armature assembly and the other slot pair for receiving a portion of the armature return spring.

7. A miniaturized electromagnetic relay according to claim 5, characterized in that the C-shaped wall is provided with an opening alignable with said yoke slot, said opening being effective to receive a movable driving member having a T-shape for engaging against the arm of the armature located in said yoke opening with its bottom end and on its upper cross-bar with at least one of the movable contact bearing blades.

8. A miniaturized electromagnetic relay according to claim 1, characterized in that said housing is provided with an inwardly directed projection, effective to be inserted between said C-shaped perpendicularly extending wall and the contact bearing blades, to complete the insulating of the magnetic circuit from the electric circuit enclosed within said housing.

9. A miniaturized electromagnetic relay according to claim 1, characterized in that said housing is provided with means effective to hold the yoke-coil assembly in its position.

* * * * *